United States Patent [19]

Fischer et al.

[11] 4,223,592

[45] Sep. 23, 1980

[54] PNEUMATIC OPERATING-MECHANISM CONSTRUCTION

[75] Inventors: William H. Fischer, Wilkins Township, Allegheny County; Willie B. Freeman, Penn Township, Delaware County, both of Pa.

[73] Assignee: Westinghouse Electric Corp., Pittsburgh, Pa.

[21] Appl. No.: 937,246

[22] Filed: Aug. 28, 1978

[51] Int. Cl.[3] ..... F01B 1/02; F15B 13/043; F15B 13/06

[52] U.S. Cl. ..... 91/189 A; 91/394; 91/401; 91/459; 91/461; 200/148 R

[58] Field of Search ..... 91/459, 461, 394, 396, 91/52, 376, 469, 401, 189 R, 189 A, 170 R; 200/148 R

[56] References Cited

U.S. PATENT DOCUMENTS

| | | | |
|---|---|---|---|
| 2,986,120 | 5/1961 | Murek | 91/396 X |
| 3,147,670 | 9/1964 | Spencer | 91/461 X |
| 3,169,452 | 2/1965 | Dugin | 91/461 X |
| 3,476,014 | 11/1969 | Churchill, Jr. et al. | 91/401 X |
| 3,815,476 | 6/1974 | Green et al. | 91/469 X |
| 3,893,374 | 7/1975 | Hirasawa | 91/461 |
| 4,131,775 | 12/1978 | Meyer et al. | 200/148 R |

*Primary Examiner*—Irwin C. Cohen
*Attorney, Agent, or Firm*—M. S. Yatsko

[57] ABSTRACT

An improved pneumatic operating mechanism construction is provided including the usual stationary operating cylinder with a movable reciprocally-operable driving piston member movable therewithin, and having an extremely-fast pneumatic valve-device cooperable with a movable valve-sealing member attached to, and carried by, the driving side of the movable driving piston. Additionally, a valve-piston bore is provided internally within the stationary valve-housing member, within which reciprocally pneumatically operates the movable valve piston.

An exhaust-port opening is provided being pneumatically communicating to the region interposed between the movable valve piston and the movable valve-sealing member, which is carried by the movable driving piston. The result is an extremely-fast valve action providing for high-pressure operating fluid, such as compressed air, for example, to be provided to the driving face of the movable driving piston.

The return movement of the movable driving piston may be effected either by a return spring means, which is charged during the driving stroke of the movable driving piston, or, alternatively, by pneumatic means, if desired, providing high-pressure gas, for example, to the opposite non-driving face of the movable driving piston.

4 Claims, 5 Drawing Figures

PNEUMATIC OPERATING-MECHANISM CONSTRUCTION

CROSS-REFERENCE TO RELATED APPLICATIONS

Reference is made to the below-listed applications assigned to the same assignee as the present application:

1. "Improved Double-Flow Puffer-Type Single Pressure Compressed-Gas Circuit-Interrupter" by C. F. Cromer et al., Ser. No. 645,752, filed Dec. 31, 1975, now U.S. Pat. No. 4,123,636.

2. "Improved Compressed-Gas Circuit-Interrupters Of The Puffer-Type Having Improved Supporting, Shielding, And Assembly Features" by J. R. Meyer et al., Ser. No. 738,803, filed Nov. 4, 1976, now U.S. Pat. No. 4,131,775.

BACKGROUND OF THE INVENTION

In the field of circuit-interruption there is an important need for fast contact separation movement in high-power compressed-gas circuit-interrupters. Reference may be made to U.S. Pat. No. 4,131,775 by Jeffry R. Meyer and Robert L. Hess, entitled, "Improved Compressed-Gas Circuit-Interrupters of The Puffer-Type Having Improved Supporting, Shielding And Assembly Features", and assigned to the assignee of the instant patent application, for a description of a typical high-power puffer-type circuit-interrupter, which is opened by a pneumatic operating mechanism of somewhat generally similar construction and characteristics to that set forth in the instant patent application.

In other words, the instant patent application describes an improved very high-speed operating mechanism which may be substituted into the puffer-type compressed-gas circuit-interrupter of the aforesaid patent application rendering it thereby of considerably higher speed and operation, for example, reducing the opening time of the breaker from 2.43 cycles to 2.0 cycles.

The entrance of high-pressure gas, such as compressed air, for example, to the driving side of the movable driving piston of the operating mechanism of the aforesaid circuit-interrupter may be considerably improved by the improvements described herein. Closing operation is effected, for example, by the unlatching or release of a spring means, which is charged under spring tension during the opening operation. In other words, the circuit-breaker is opened by pneumatic means such as the movement of a movable driving piston and is closed, that is the separable contacts are reclosed, by a release of the previously charged closing spring means.

However, it is to be clearly understood that the improved pneumatic operating mechanism of the instant patent application may be used in a wide variety of different applications, and only one such application pertains to the circuit-interrupting art. Other applications, one of which will be described hereinafter, contemplates the application of the improved high-speed pneumatic operating mechanism of the instant patent application to a high-speed metallic-stamping structure, which may advantageously employ the high-speed pneumatic operating mechanism described in the instant patent application.

SUMMARY OF THE INVENTION

In accordance with the present invention, there is provided an improved high-speed pneumatic operating mechanism of the piston-and-cylinder type in which the movable driving piston carries a movable valve-sealing member, which is attached to, and carried by, the driving side of the movable driving piston.

This movable valve-sealing member cooperates within a stationary valve-piston bore, which is provided internally within the stationary valve-body housing-member, the latter of which accommodates a reciprocally-movable valve piston.

The operation is such that during a typical driving operation of the improved pneumatic operating mechanism, high-pressure operating fluid, such as high-pressure air, for example, is applied to the movable valve piston causing it to move within the stationary valve-piston bore and make abutting contacting engagement with the movable valve-sealing member, which also is positioned within the said stationary valve-piston bore.

An exhaust port communicates to the region between the movable valve-sealing member, carried by the driving piston, and the movable valve piston, reciprocally-operable within the stationary valve-piston bore provided in the valve-housing member.

Following a predetermined opening travel of the movable valve-piston within the stationary valve housing member, separation occurs between the movable valve-piston and the movable valve-sealing member, carried by the driving piston, the latter assuming high-speed characteristics or action and rapidly moving in a driving direction within the surrounding stationary operating cylinder.

Retraction of the movable driving piston may be effected in many ways, such as, for example, a release of a spring-charging means, which was charged during the driving action of the movable driving piston. Alternatively, if desired, pneumatic means may be provided to pneumatically effect the return, or the retraction of the main driving piston.

DESCRIPTION OF THE PREFERRED EMBODIMENTS

Figure 1:
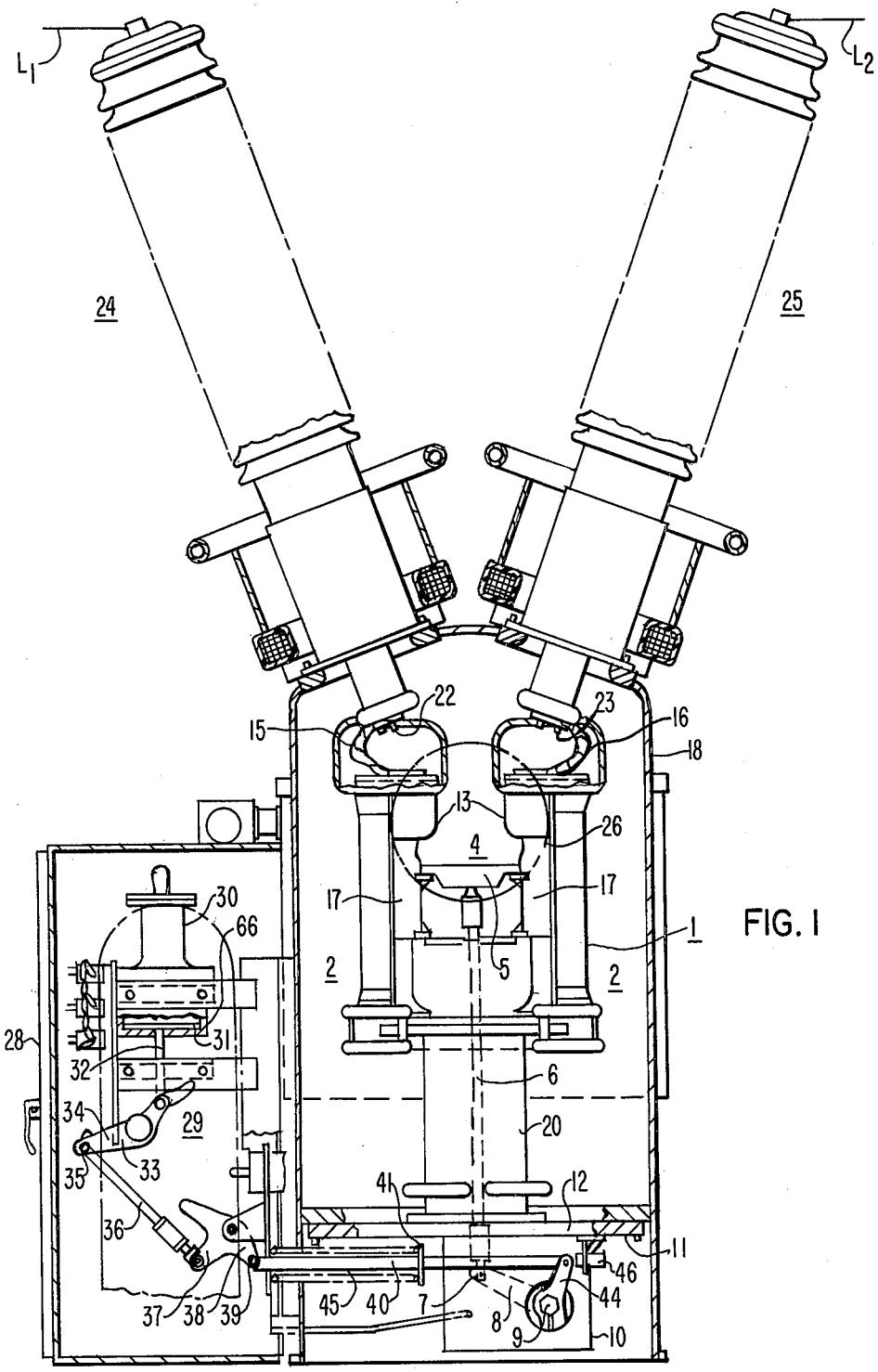
FIG. 1 is a vertical sectional view taken through an improved tank-type compressed-gas circuit-interrupter embodying the improved pneumatic high-speed mechanism of the present invention, with the circuit-breaker contact structure being illustrated in the closed-circuit position.
Figure 2:
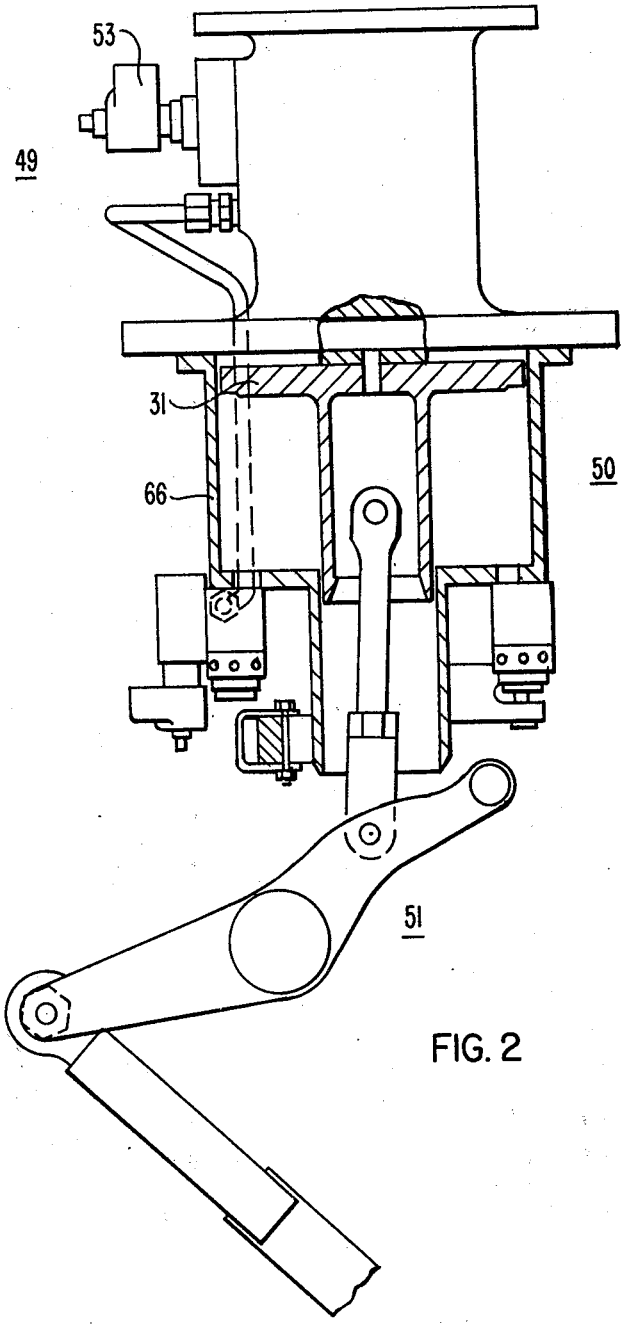
FIG. 2 illustrates, to an enlarged scale, with a portion of the stationary operating cylinder being shown in vertical section, the improved pneumatic high-speed operating mechanism of the instant application, with the component parts being illustrated in their static non-driving position, and with, of course, the circuit-breaker structure being thus in the closed-circuit position.

Referring to the drawings, and more particularly to FIGS. 1 and 2 thereof, it will be observed that FIG. 1 illustrates an interrupter 1 comprising a pair of conjointly-acting puffer-type gas-modules 2 of the general type set forth in the U.S. Pat. No. 4,123,636 and assigned to the assignee of the instant patent application. As shown, the two puffer-type gas modules 2 are electrically and mechanically tied together by a horizontally-extending movable bridging-bar construction 4 having pivotally connected thereto, as at 5, an upstanding main movable insulating operating rod 6.

The movable operating rod 6 is, as shown, pivotally connected at 7 to a bell-crank lever 8, which is rigidly affixed to a rotatable main operating shaft 9. A lever box 10 is affixed, as by welding, for example, to the lower surface 11 of the main metallic support-plate 12.

Each of the gas-modular units 2 comprises an upper relatively-stationary contact structure 13 which, in the closed-circuit position of the interrupter, as indicated in FIG. 1, make good contacting engagement with an annular movable main contact (not shown) affixed to an operating-cylinder assembly 17, the latter moving downwardly during the opening operation over a relatively-fixed piston structure (not shown). A more detailed description of the operation of the circuit-interrupter illustrated in FIG. 1 may be found in the referenced applications.

As will be obvious, the two modular puffer-type gas-units 2 operate simultaneously by their downward cooperative opening movement, and, in electrical series, constitute an electrical piece of interrupting equipment having a voltage rating of 242 Kv with an interrupting capacity of 50 to 63,000 amperes, for example. The full-load continuous current rating of the puffer-type circuit-interrupter, for example, would be 2,000 to 4,000 amperes.

Also illustrated in FIG. 1, the two modular units 2 are collectively supported by an upstanding insulating support cylinder 20, which, in turn, is fixedly bolted to the relatively-heavy metallic support-plate 12, referred to hereinbefore.

The flexible connectors 15, 16, connected respectively to the upper stationary contact structures 13, may be manually secured to the lower terminal-studs 22, 23 of the two terminal-bushings 24, 25 by means of the manhole service opening 26 provided in the side wall of the tank structure 18.

It will be noted that attached to the side of the metallic tank 18 is the mechanism housing 28, together with its internally-located pneumatic operating mechanism 29. Generally, this is of the type which, when operated, will effect opening of the circuit-breaker 1. Thus, suitable pneumatic valve structure 30 will admit high-pressure gas to a main driving piston 31, which will, when pneumatically moved downwardly, effect downward movement of a main piston-rod 32 and consequent clockwise rotation of a bell-crank lever 33 having an arm 34, which is pivotally connected, as at 35 by an operating link 36 to a second bell-crank lever 37.

A second arm 38 of the second bell-crank lever 37 has pivotally connected thereto, as at 39, a connecting rod 40 having secured thereto a spring seat 41, which is biased by a spring 45 toward the right, as viewed, in FIG. 1, in a direction to close the double-break circuit-breaker 1.

The connecting rod 40 is pivotally connected to a rotatable bell-crank lever assembly 44, which operates the main rotatable operating shaft 9. The construction is such that the closing compression spring 45 effects a rapid closing of the circuit-interrupter 1, a closing shock-absorber 46 being preferably provided to limit the closing travel of the circuit-breaker 1.

During the opening operation, the pneumatic valve mechanism 30 is actuated to effect, through the main driving piston 31 and the aforesaid interconnecting linkage, the rapid downward opening movement of both movable contact structures (not shown).

It is desirable to utilize a high-speed operating mechanism 29 to effect very fast opening separating motion of the movable separable contact structure. The typical puffer-type circuit-interrupter, previously described, utilizes an air-open, and spring-closed mechanism 29. Interrupting time may be, for example, 2.43 cycles, and it is desirable, in order to meet customer needs, to provide a 2.0 cycle opening time for even higher speed opening operation. The utilization of the improved high-speed operating mechanism 29 described herein enables the attainment of such an improved high-speed interrupting time, which, as mentioned, is roughly 2.0 cycles.

As illustrated in FIG. 2, there are essentially three main component operating assemblies. The first assembly is the opening-valve assembly 49, the second component assembly is the movable driving piston assembly 50 and the third component assembly is the linkage system 51.

Figure 3:
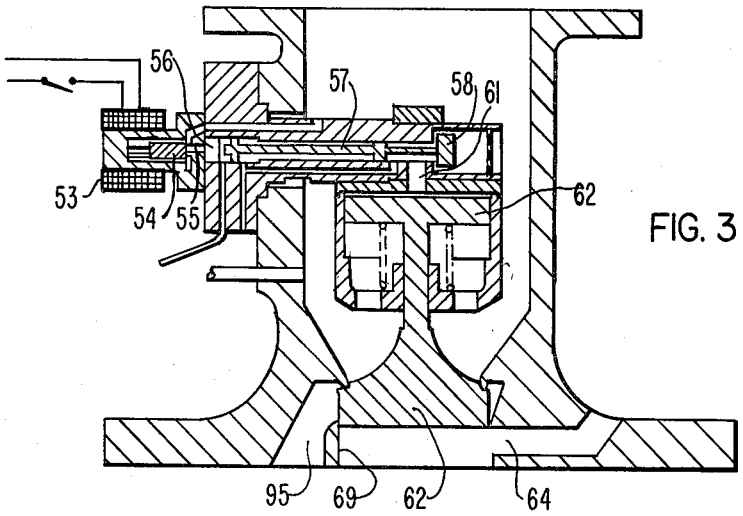
FIG. 3 illustrates, to an enlarged scale, and in vertical section, a portion of the stationary operating cylinder and driving piston of FIG. 2, with the valve housing broken away in vertical section, and more clearly illustrating the component parts of the pneumatic valve structure, again the component parts being illustrated in their static, non-driving position, and again the separable circuit-breaker contacts being closed.
Figure 4:
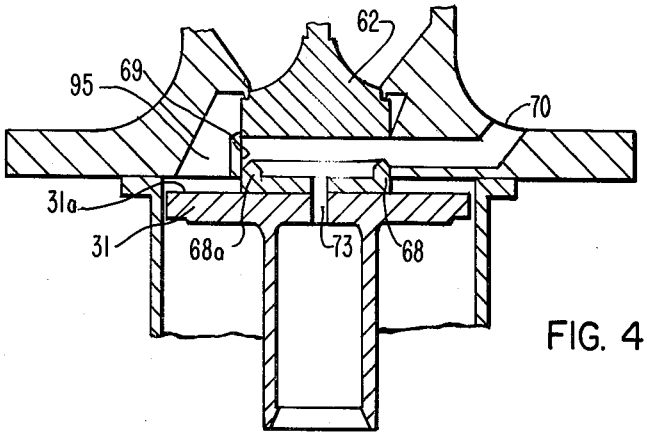
FIG. 4 illustrates an enlarged detailed view of the cooperation between the movable valve piston and the cooperable movable-valve sealing member carried by the movable driving piston, again the several parts being illustrated in their static non-driving position.

An opening operation of the circuit-breaker 1 is started when the trip coil 53 is energized. A plunger 54 (FIG. 3) is displaced to the left, thus permitting compressed air 55 to push the pistons 56, 57 and 58 towards the right. This causes the piston 57 to close the exhaust port and the movable piston 58 to allow compressed air to pass through the duct 61 and push the movable piston 62 downwardly. The downward motion of the movable piston 62 closes the exhaust port 64 and also opens the flow of compressed air through the duct 95 into the operating cylinder 66 (FIG. 2) where it then pushes the main driving piston 31 downwardly, thereby causing the circuit-breaker breaker contacts to open and, in addition, charging the closing spring 45.

It will be noticed that there is provided a movable cup-shaped valve-sealing member 68, which is attached to, and carried by, a first driving side **31*a* of the movable main driving piston 31. The sealing cup 68 on its outside diameter is a sliding fit within the valve-piston bore 69. In the mechanism-closed position, the sealing cup 68 extends into the stationary bore 69** approximately 0.375 inches, for example.

An opening operation is accomplished by an abutting contact between the movable valve piston 62 and the cup-shaped sealing member 68. The movable sealing member 68 blocks the high-pressure air from the bottom of the movable valve piston 62 and also blocks the high-pressure air from escaping through the exhaust port 70. The blocking action takes place until the main driving piston 31 travels 0.375 inches, for example. At that time, the downward force on the movable valve piston 62 is larger than the upward force thereon, and no rebounding action takes place. Also, at this time the movable valve piston 62 covers the exhaust port 70 so that there is no air loss. When the movable valve piston 62 travels downwardly, it makes contact with the sealing edge 68*a* of the movable cup-shaped sealing member 68. The sliding fit between the cup-shaped sealing member 68 and the stationary valve bore 69, and the seal between the movable cup top edge 68*a* and the bottom surface of the movable valve member 62 prevents the air from getting to the bottom surface of movable valve member 62. The movable valve piston 62, movable cup-shaped sealing member 68 and the movable driving piston 31 all travel downwardly together, as a movable unitary structure, for the first 0.125 inches of travel of the movable driving piston 31, until compressed air flows through over 95 to flow against the piston 31.

Preferably, a hole 73 bleeds off any air that may get past the seal between the movable valve member 62 and the movable cup-shaped sealing member 68.

Tests have been successfully run on this new pneumatic high-speed operating mechanism 29 incorporating the improved movable cup-shaped sealing member 68 carried by the movable driving piston 31, and the previous 2.43 cycle opening interrupting time has been consequently reduced to 2.31 cycles, for example.

Improved advantages of the incorporation of the movable cup-shaped sealing member 68, attached to the movable driving piston 31, are as follows:

1. There is improved efficiency of the opening valve 49 resulting in reduced opening time.

2. There is an improved efficiency obtained by eliminating valve rebound and air loss on the opening operation.

3. The design change is comparatively very inexpensive.

4. The cup-shaped sealing member 68 can be made as an "add-on" feature, or it may be made during the manufacture integrally with the main driving piston 31.

5. The addition of the movable cup-shaped sealing member 68 does not affect the closing or the close-open operations.

During the closing operation, the closing compression spring 45 may be released by an electrically-actuated latch, and the separable contact structure reclosed under the spring pressure. Such a reclosing action, initiated by the charged closing spring 45, will, in addition, effect reclosure of the movable main driving piston 31.

It will be observed that the present invention relates to an improved high-speed pneumatic operating mechanism 29, which may advantageously be incorporated in a high-speed compressed-gas circuit-interrupter 1, as illustrated in FIG. 1. However, such an application is not all-inclusive, inasmuch as the improved high-speed operating mechanism 29 of the instant patent application may be used in a wide variety of other different applications in areas other than that of the circuit-interruption art.

Figure 5:
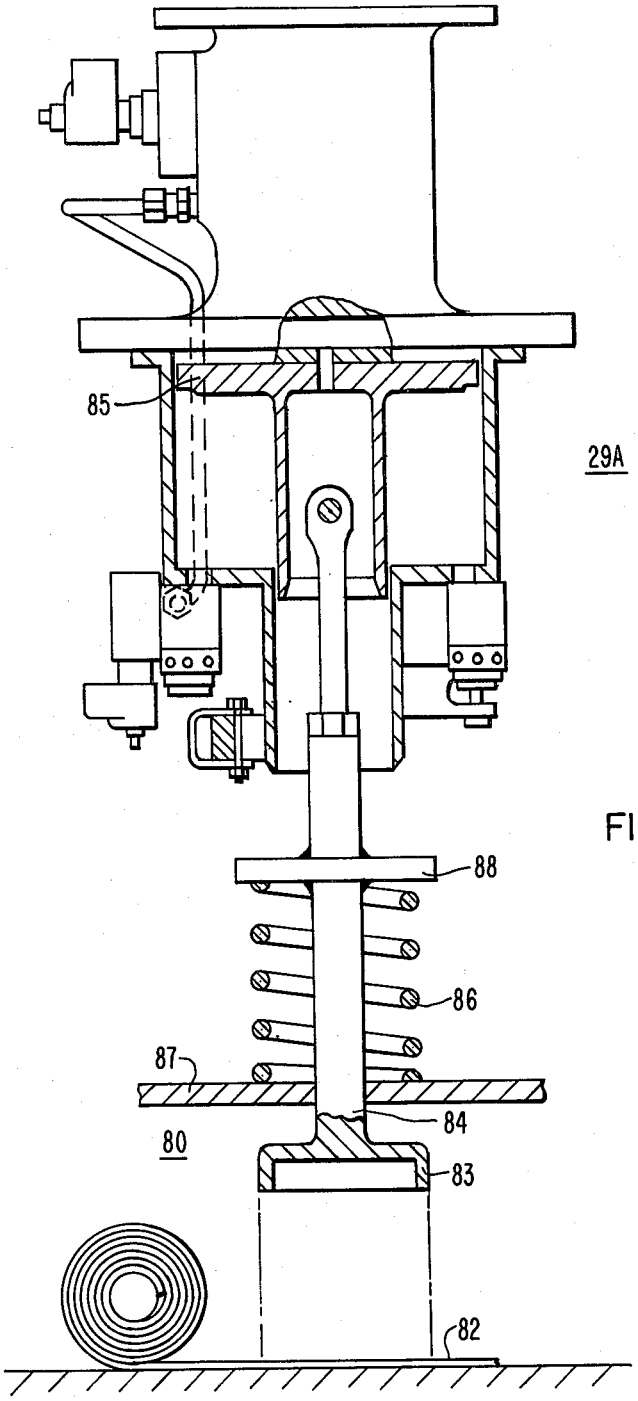
FIG. 5 illustrates an alternate application of the improved pneumatic high-speed operating mechanism as applied to a metallic-stamping machine, in which the several parts are illustrated in their static, non-driving position.

For example, FIG. 5 shows an application using the same high-speed pneumatic operating mechanism 29*a* as applied to a metal-stamping machine 80, in which circular holes, for example, may be stamped out sequentially on a running strip of metallic sheeting 82. The stamping plunger 83 is shown as attached, by a pivotally-mounted movable driving link 84, to the driving piston 85, which operates the same as the driving piston described hereinbefore.

Preferably, a return-compression spring may be provided, as designated by the reference numeral 86, being preferably interposed between a stationary plate member 87 and a movable spring-stop 88, which is secured, as by welding, for example, to the linearly-movable stamping plunger 83. Other applications of the improved high-speed pneumatic operating mechanism of the instant invention will readily occur to those skilled in the art.

Although there have been illustrated and described several specific structures, it is to be clearly understood that the same were merely for the purpose of illustration, and that changes and modifications may readily be made therein by those skilled in the art, without departing from the spirit and scope of the invention.

We claim:

1. An improved pneumatic operating mechanism comprising, in combination:

means defining a stationary operating cylinder and a movable main driving piston reciprocally operable therewithin;

pneumatic valve means operable to admit a pneumatic operating fluid to a first driving side of said reciprocally-operable main driving piston;

said pneumatic valve means comprising a stationary valve-body housing-member having a stationary valve-piston bore provided therein;

a movable valve piston reciprocally operable within said stationary valve-piston bore;

a movable valve-sealing member attached to said first driving side of said main driving piston and carried by said main driving piston;

said movable valve sealing member being positioned within said stationary valve piston bore of the stationary valve body housing member in the non-driving condition of the pneumatic operating mechanism;

means for admitting high-pressure pneumatic operating fluid to the driving side of said movable valve piston during a driving operation of the operating mechanism to thereby force it into abutting sealing engagement with said movable valve sealing member during the first portion of the operation;

means defining an exhaust port means pneumatically communicating to the region interposed between the movable valve piston and said valve sealing member within the stationary valve piston bore;

whereby during the final portion of the driving operation of the pneumatic operating mechanism the movable valve piston halts and blocks off the exhaust-port means whereas the main movable driving piston continues in its reciprocal driving motion within the operating cylinder to its final end driving position.

2. The improved pneumatic-operating mechanism of claim 1, wherein a bleeding hole is provided in the movable valve sealing member.

3. The improved pneumatic operating mechanism of claim 1, wherein spring means are utilized to effect return of the main movable driving piston.

4. The improved pneumatic operating mechanism of claim 1, wherein electrical solenoid value means are utilized to effect initial pneumatic motion of the movable valve piston within the stationary valve-body housing-member.

* * * * *